US009493964B1

(12) United States Patent
Torrens

(10) Patent No.: US 9,493,964 B1
(45) Date of Patent: Nov. 15, 2016

(54) ADJUSTABLE STRIKER PLATE

(71) Applicant: Edward P. Torrens, Tampa, FL (US)

(72) Inventor: Edward P. Torrens, Tampa, FL (US)

( * ) Notice: Subject to any disclaimer, the term of this patent is extended or adjusted under 35 U.S.C. 154(b) by 0 days.

(21) Appl. No.: 14/210,664

(22) Filed: Mar. 14, 2014

(51) Int. Cl.
*E05B 15/02* (2006.01)
*E05B 15/00* (2006.01)

(52) U.S. Cl.
CPC ..... *E05B 15/024* (2013.01); *E05B 15/021* (2013.01); *E05B 15/0205* (2013.01)

(58) Field of Classification Search
CPC ..... E05B 15/0205; E05B 15/021; E05B 15/024; E05B 15/025; E05B 2015/0275; E05B 2015/028
USPC ..... 292/340, 341.18, 341.19, DIG. 60
See application file for complete search history.

(56) References Cited

U.S. PATENT DOCUMENTS

| | | | | | |
|---|---|---|---|---|---|
| 964,789 | A | * | 7/1910 | Kozlowski | 292/341.18 |
| 1,022,222 | A | * | 4/1912 | Augenbraun | 292/341.18 |
| 1,318,382 | A | * | 10/1919 | Herby | 292/341.12 |
| 1,374,731 | A | * | 4/1921 | Hage | 292/341.12 |
| 1,612,225 | A | * | 12/1926 | Schoy | 292/341.18 |
| 1,793,115 | A | * | 2/1931 | Model | 292/341.18 |
| 1,913,444 | A | * | 6/1933 | Herdeg | 292/341.18 |
| 2,065,732 | A | * | 12/1936 | Peace | 292/341.18 |
| 2,231,414 | A | * | 2/1941 | Model | 292/341.18 |
| 2,412,497 | A | * | 12/1946 | Edwards | 292/341.18 |
| 2,486,772 | A | * | 11/1949 | Wuerl | 292/341.18 |
| 2,650,848 | A | * | 9/1953 | Garbs | 292/341.18 |
| 3,006,677 | A | * | 10/1961 | Royalty | 292/341.18 |
| 3,179,458 | A | * | 4/1965 | Sconzo | 292/341.15 |
| 3,245,709 | A | * | 4/1966 | Rosenberger | 292/341.13 |
| 3,395,935 | A | * | 8/1968 | Rosenberger | 292/341.13 |
| 3,760,333 | A | * | 9/1973 | Stieler | 439/271 |
| 4,113,293 | A | * | 9/1978 | Paquette | 292/341.18 |
| 4,288,120 | A | * | 9/1981 | Moore | 292/341.18 |
| 4,813,724 | A | * | 3/1989 | Dietrich | 292/341.12 |
| 4,892,341 | A | * | 1/1990 | Dietrich | 292/341.12 |
| 4,893,854 | A | * | 1/1990 | Dietrich | 292/341.12 |
| 5,171,050 | A | * | 12/1992 | Mascotte | 292/341.18 |
| D351,781 | S | * | 10/1994 | DeWitt | D8/344 |
| 2003/0057718 | A1 | * | 3/2003 | Stoehr | 292/340 |

FOREIGN PATENT DOCUMENTS

| | | | | |
|---|---|---|---|---|
| CA | 1264786 | * | 1/1990 | |
| DE | 2215305 | * | 10/1973 | |
| GB | 2230294 A | * | 10/1990 | E05B 15/02 |

* cited by examiner

*Primary Examiner* — Carlos Lugo

(57) ABSTRACT

A striker plate has an exterior edge, an interior edge, and a latch-receiving hole. The latch-receiving width is defined by inner and outer sides of the latch-receiving hole. A supplemental hole formed in the striker plate constitutes an inwardly extending extension of the latch-receiving hole. An adjustment block is coupled to the striker plate adjacent to the supplemental hole. The threaded end of a threaded adjustment bolt is received in a threaded aperture of the adjustment block. The threaded adjustment bolt has a head in the supplemental hole accessible to a user for rotation and axial movement to and from the latch-receiving hole to effectively vary the width of the latch-receiving hole.

6 Claims, 4 Drawing Sheets

ADJUSTABLE STRIKER PLATE

BACKGROUND OF THE INVENTION

Field of the Invention

The present invention relates to an adjustable striker plate system and more particularly pertains to abating play between a latch and an associated striker plate by adjusting a lateral width in a latch-receiving hole of the striker plate.

Description of the Prior Art

The use of striker plate systems of known designs and configurations is known in the prior art. More specifically, striker plate systems of known designs and configurations previously devised and utilized for the purpose of adjusting striker plates are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe adjustable striker plate system that allows abating play between a latch and an associated striker plate by adjusting a lateral width in a latch-receiving hole of the striker plate.

In this respect, the adjustable striker plate system according to the present invention substantially departs from the conventional concepts and designs of the prior art, and in doing so provides an apparatus primarily developed for the purpose of abating play between a latch and an associated striker plate by adjusting a lateral width in a latch-receiving hole of the striker plate.

Therefore, it can be appreciated that there exists a continuing need for a new and improved adjustable striker plate system which can be used for abating play between a latch and an associated striker plate by adjusting a lateral width in a latch-receiving hole of the striker plate. In this regard, the present invention substantially fulfills this need.

SUMMARY OF THE INVENTION

In view of the foregoing disadvantages inherent in the known types of striker plate systems of known designs and configurations now present in the prior art, the present invention provides an improved adjustable striker plate system. As such, the general purpose of the present invention, which will be described subsequently in greater detail, is to provide a new and improved adjustable striker plate system and method which has all the advantages of the prior art and none of the disadvantages.

To attain this, the present invention essentially comprises a striker plate with an exterior edge, an interior edge, and a latch-receiving hole. The latch-receiving hole has inner and outer sides defining the latch-receiving hole width there between. A supplemental hole formed in the striker plate constitutes an inwardly extending extension of the latch-receiving hole. An adjustment block is coupled to the striker plate adjacent to the supplemental hole. The threaded end of a threaded adjustment bolt is received in a threaded aperture of the adjustment block. The threaded adjustment bolt has a head in the supplemental hole accessible to a user for rotation and axial movement to and from the latch-receiving hole to effectively vary the width of the latch-receiving hole.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable striker plate system which has all of the advantages of the prior art striker plate systems of known designs and configurations and none of the disadvantages.

It is another object of the present invention to provide a new and improved adjustable striker plate system which may be easily and efficiently manufactured and marketed.

It is further object of the present invention to provide a new and improved adjustable striker plate system which is of durable and reliable constructions.

An even further object of the present invention is to provide a new and improved adjustable striker plate system which is susceptible of a low cost of manufacture with regard to both materials and labor, and which accordingly is then susceptible of low prices of sale to the consuming public, thereby making such adjustable striker plate system economically available to the buying public.

Lastly, another object of the present invention is to provide an adjustable striker plate system for abating play between a latch and an associated striker plate by adjusting a lateral width in a latch-receiving hole of the striker plate.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
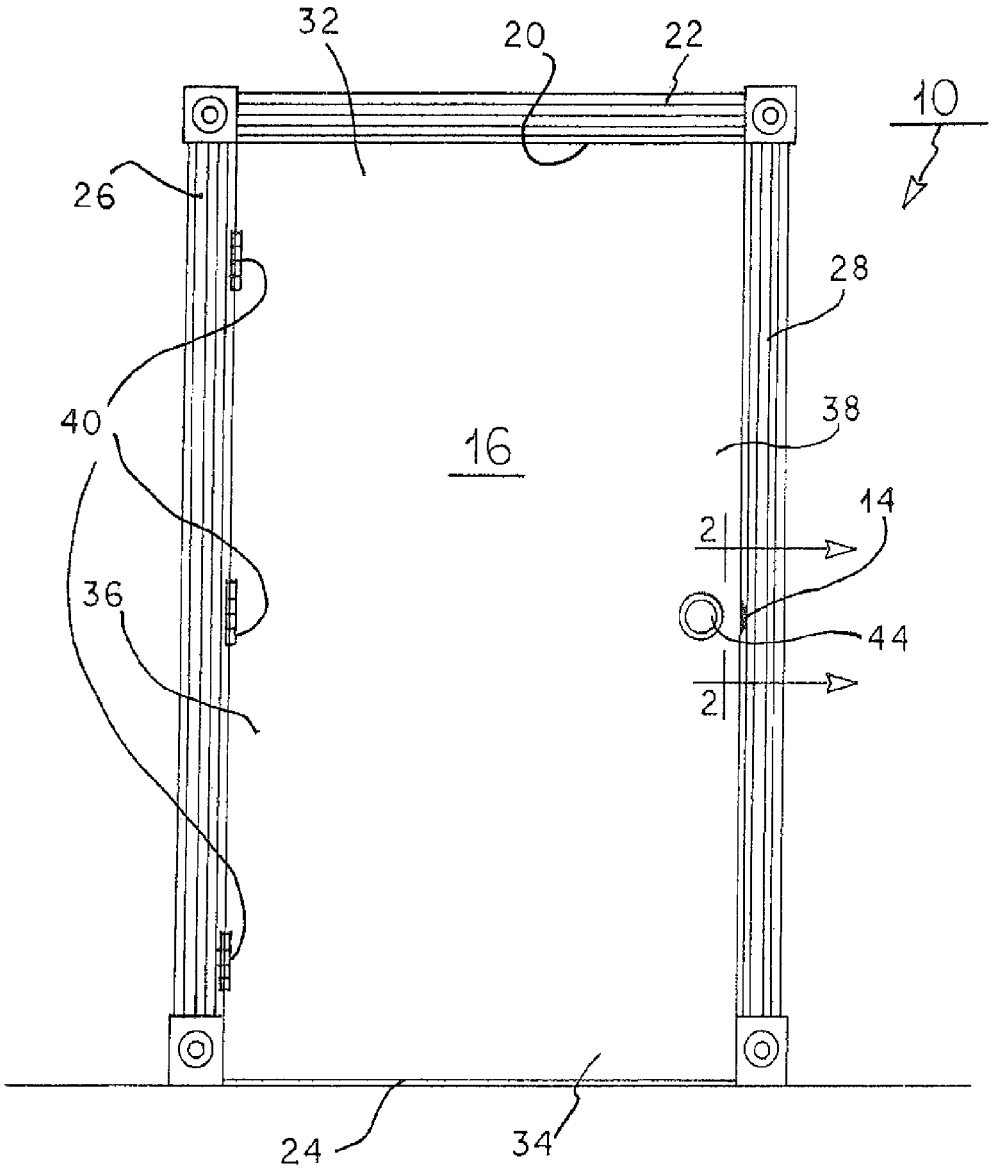
FIG. 1 is a front elevational view of an adjustable striker plate system constructed in accordance with the principles of the present invention.
Figure 2:
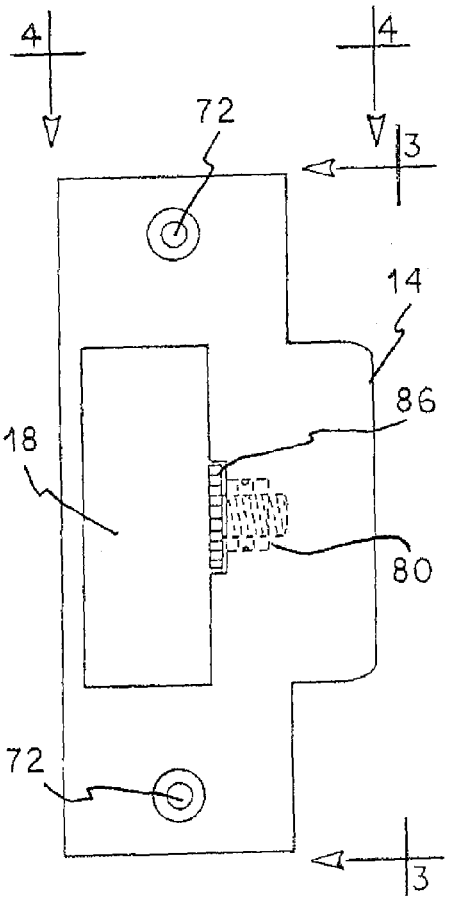
FIG. 2 is a cross sectional view taken along line 2-2 of FIG. 1.
Figure 3:
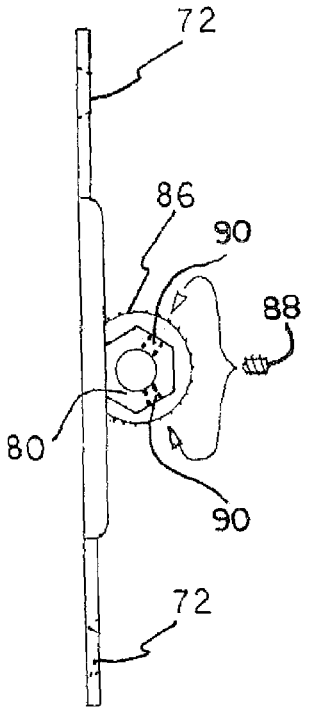
FIG. 3 is a side elevational view taken along line 3-3 of FIG. 2.
Figure 4:
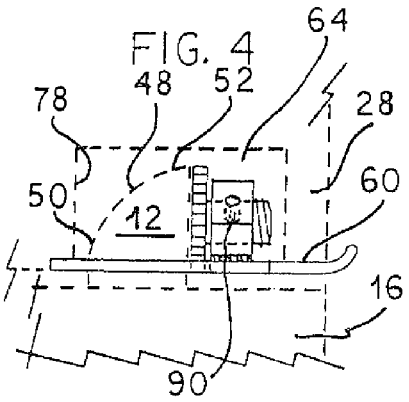
FIG. 4 is a plan view taken along line 4-4 of FIG. 2.
Figure 5:
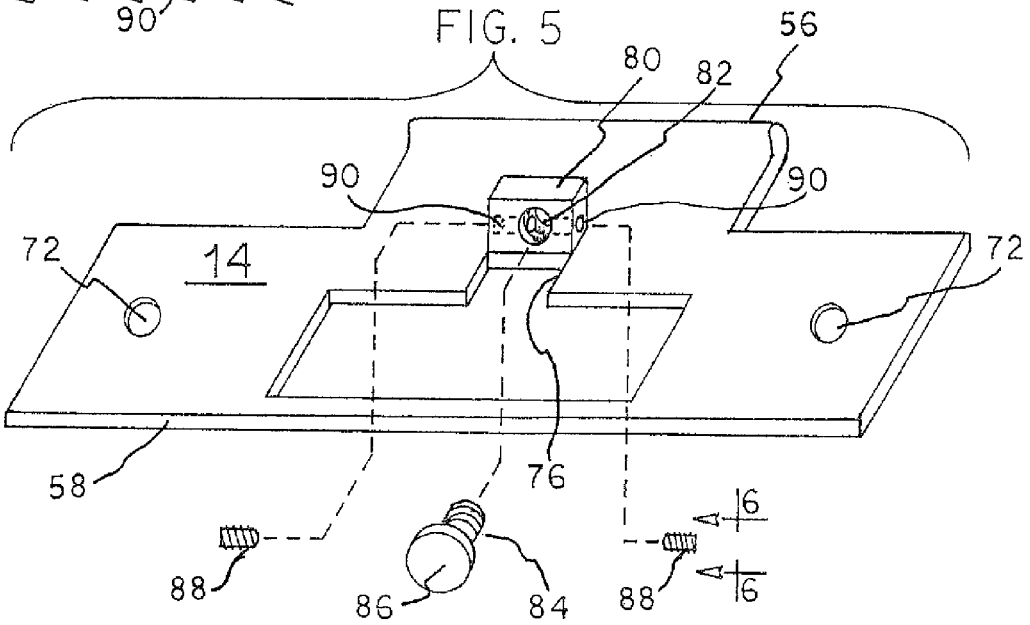
FIG. 5 is an exploded perspective illustration of the striker plate shown in the prior Figures.
Figure 6:
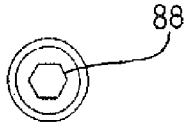
FIG. 6 is a side elevational view taken along line 6-6 of FIG. 2.
Figure 7:
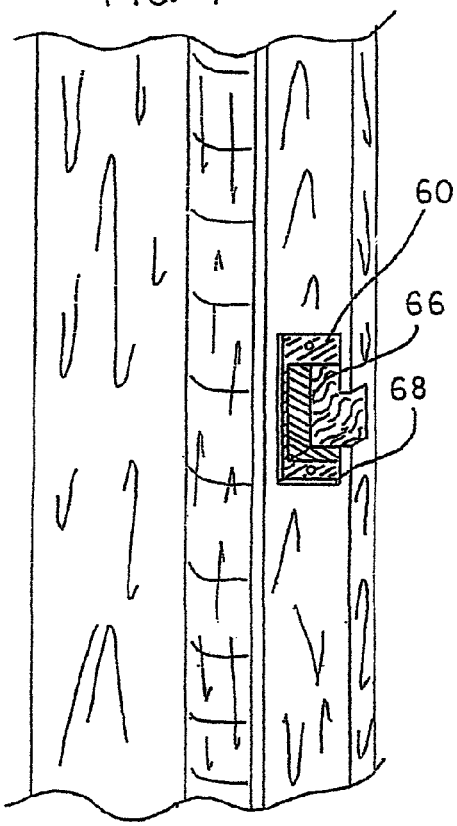
FIG. 7 is a perspective showing of the striker plate and associated components of the system shown in the prior Figures.

With reference now to the drawings, and in particular to FIG. 1 thereof, the preferred embodiment of the new and improved adjustable striker plate system embodying the principles and concepts of the present invention and generally designated by the reference numeral 10 will be described.

The present invention, the adjustable striker plate system 10 is comprised of a plurality of components. Such components in their broadest context include a striker plate, a supplemental hole in the striker plate, an adjustment block, and a threaded adjustment bolt. Such components are individually configured and correlated with respect to each other so as to attain the desired First provided are a latch 12, an associated striker plate 14, and a door 16. Abating play between the latch and the striker plate is done by adjusting a lateral width in a latch-receiving hole 18 of the striker plate.

Next provided is a door passageway 20. The door passageway is bounded by a horizontal upper casing 22, a horizontal lower threshold 24, a vertical first side casing 26, and a vertical second side casing 28 laterally spaced from the vertical first side casing.

The door 16 is bounded by a horizontal upper edge 32, a horizontal lower edge 34, a vertical first edge 36, and a vertical second edge 38 laterally spaced from the vertical first edge. Hinges 40 pivotally couple the vertical first edge of the door to the vertical first side casing of the door passageway for swinging movement of the door between an open position and an closed position. The open position is with the door out of the door passageway. The closed position is with the door within the door passageway.

Next provided is a door handle 44. The door handle is mounted within the door adjacent to the vertical second edge. The door handle is adapted to be pushed and pulled for allowing swinging the door in a vertical plane between the open position and the closed position. The door handle is adapted to be rotated about a horizontal axis.

The latch 12 is mounted in the door adjacent to the door handle. The latch is axially movable between a retracted orientation within the door and an extended orientation projecting from the vertical second edge of the door. The latch is axially movable in response to moving the door to the closed position and to the rotation of the door handle by a user. The latch has a generally rectangular cross sectional configuration with a free exterior end 48. The free exterior end is in a vertical plane at an angle with respect to the vertical second side casing of the door passageway and the vertical second edge of the door when the door is in the closed position. The free exterior end of the latch has an interior edge 50 adjacent to the door when in an extended orientation. The free exterior end of the latch has an exterior edge 52 spaced from the door when in an extended orientation. The latch has a width between the interior edge 50 and the exterior edge 52.

The striker plate 14 has a generally planar configuration. The striker plate has an exterior edge 56 and an interior edge 58. A shallow recess 60 in the vertical second side casing receives the striker plate. The striker plate has a latch-receiving hole 18 in a generally rectangular configuration. A deep recess 64 is provided in the vertical second side casing adjacent to the generally rectangular latch-receiving hole. The latch-receiving hole has an inner side 66 and an outer side 68 which define a hole width. The striker plate has a plurality of countersunk holes 72 for coupling the striker plate to the vertical second side casing. The exterior edge 56 of the striker plate is formed with an inwardly extending bend 66 directed toward the vertical second side casing. The inwardly extending bend is adapted to be contacted by the free exterior end 48 of the latch when in the extended position to move the latch to the retracted orientation for movement into the latch-receiving hole 18 in the striker plate and into the deep recess 64.

Next provided is a supplemental hole 76 having a rectangular configuration formed on the striker plate. The supplemental hole 76 constitutes an inwardly extending extension of the latch-receiving hole. A supplemental recess 78 is provided in the vertical second side casing beneath the supplemental hole.

An adjustment block 80 having a rectilinear configuration is next provided. The adjustment block is coupled to the striker plate and extends into the supplemental hole 76. The adjustment block has a threaded aperture 82 with an axis. A threaded adjustment bolt 84 has a threaded end received in the threaded aperture 82. The threaded adjustment bolt has a head 86 located in the supplemental recess 78. A portion of the head is accessible to the user through the supplemental hole 76 in the striker plate for rotation and axial movement to and from the latch-receiving hole to vary the width of the latch-receiving hole as a function of the width of the latch. In this manner, play between the latch and the striker plate is abated. The adjustment block has set screws 88 in threaded holes 90 to secure the position of the adjustment bolt with respect to the striker plate and the latch.

Figure 8:
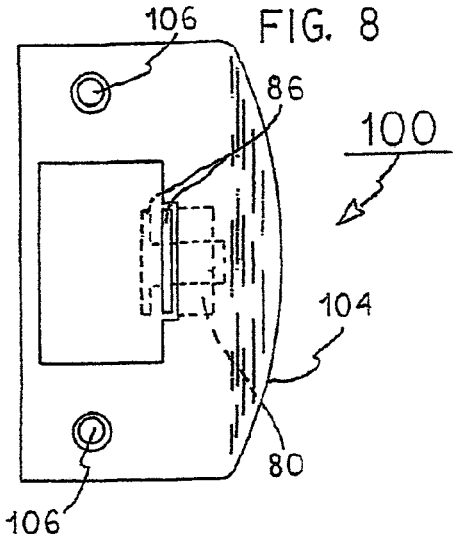
FIG. 8 is a front elevational view of a striker plate constructed in accordance with an alternate embodiment of the invention.

An alternate embodiment of the invention is shown in FIG. 8. In this embodiment, the system 100 includes two countersunk holes 106 for coupling the striker plate to a vertical portion of a door casing. The exterior edge 104 of the striker plate is arcuate and forms a bend toward the vertical portion of the door casing.

Figure 9:
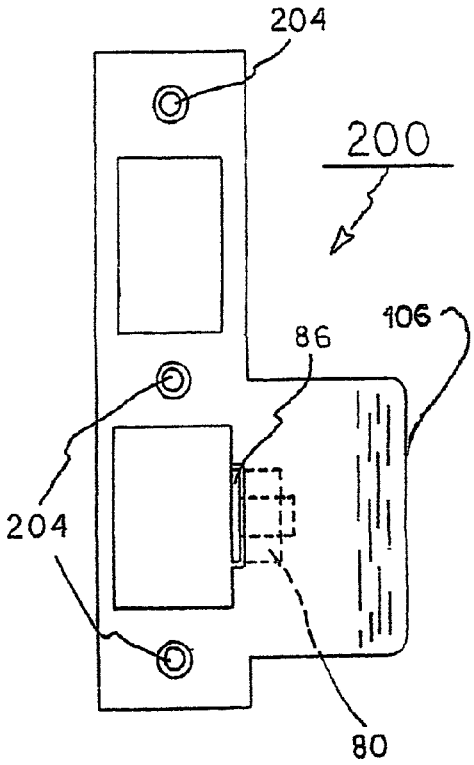
FIG. 9 is a front elevational view of a striker plate constructed in accordance with another alternate embodiment of the invention.

Another alternate embodiment of the invention is shown in FIG. 9. In this embodiment, the system 200 includes three countersunk holes 204 for coupling the striker plate to a vertical portion of a door casing. Further, the exterior edge 206 of the striker plate is arcuate and forms a bend toward the vertical portion of the door casing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable striker plate system comprising:

a striker plate having an exterior edge and an interior edge and a latch-receiving hole, the latch-receiving hole having inner and outer sides defining the latch-receiving hole width there between;

a supplemental hole formed in the striker plate and constituting an inwardly extending extension of the latch-receiving hole;

an adjustment block coupled to the striker plate adjacent to the supplemental hole, the adjustment block having a threaded aperture;

a threaded adjustment bolt with a threaded end received in the threaded aperture, the threaded adjustment bolt having a head in the supplemental hole accessible to a user for rotation and axial movement to and from the latch-receiving hole to effectively vary the width of the latch-receiving and at least one set screw operatively coupled to the adjustment block to secure the position of the threaded adjustment bolt with respect to the striker plate.

2. The system as set forth in claim 1 and further including:

knurling on the head of the threaded adjustment bolt.

3. The system (100) as set forth in claim 1 and further including:

two countersunk holes (106) for coupling the striker plate to a vertical portion of a door casing, and wherein the exterior edge (104) of the striker plate is arcuate and forms a bend toward the vertical portion of the door casing.

4. The system (200) as set forth in claim 1 and further including:

three countersunk holes (204) for coupling the striker plate to a vertical portion of a door casing; and wherein the exterior edge (206) of the striker plate is arcuate and forms a bend toward the vertical portion of the door casing.

5. An adjustable striker plate system comprising, in combination:

a striker plate having an exterior edge and an interior edge and a latch-receiving hole, the latch-receiving hole having inner and outer sides defining the latch-receiving hole width there between;

a supplemental hole formed in the striker plate and constituting an inwardly extending extension of the latch-receiving hole;

an adjustment block coupled to the striker plate adjacent to the supplemental hole, the adjustment block having a threaded aperture;

a threaded adjustment bolt with a threaded end received in the threaded aperture, the threaded adjustment bolt having a head in the supplemental hole accessible to a user for rotation and axial movement to and from the latch-receiving hole to effectively vary the width of the latch-receiving hole;

at least one set screw operatively coupled to the adjustment block to secure the position of the threaded adjustment bolt with respect to the striker plate; and a door passageway bounded by a horizontal upper casing, a horizontal lower threshold, a vertical first side casing, and a vertical second side casing laterally spaced from the vertical first side casing, the second vertical side casing being formed with a shallow recess for receiving the striker plate, the second vertical side casing being formed with a deep recess for receiving the latch, the second vertical side casing being formed with a supplemental recess for receiving the adjustment block.

6. An adjustable striker plate system (10) for abating play between a latch (12) and an associated striker plate (14) when an associated door (16) is closed, the abating being done by adjusting a lateral width in a latch-receiving hole 18 of a striker plate, the system comprising, in combination:

a door passageway (20) bounded by a horizontal upper casing (22), a horizontal lower threshold (24), a vertical first side casing (26), and a vertical second side casing (28) laterally spaced from the vertical first side casing;

the door (16) bounded by a horizontal upper edge (32), a horizontal lower edge (34), a vertical first edge (36), and a vertical second edge (38) laterally spaced from the vertical first edge, hinges (40) pivotally coupling the vertical first edge of the door to the vertical first side casing of the door passageway for swinging movement of the door between an open position and a closed position, the open position being with the door out of the door passageway, the closed position being with the door within the door passageway;

a door handle (44) mounted within the door adjacent to the vertical second edge, the door handle adapted to be pushed and pulled for allowing swinging the door in a vertical plane between the open position and the closed position, the door handle adapted to be rotated about a horizontal axis;

the latch (12) mounted in the door adjacent to the door handle, the latch being axially movable between a retracted orientation within the door and an extended orientation projecting from the vertical second edge of the door, the latch being axially movable in response to moving the door to the closed position and to the rotation of the door handle by a user, the latch having a generally rectangular cross sectional configuration with a free exterior end (48), the free exterior end being in a vertical plane at an angle with respect to the vertical second side casing of the door passageway and the vertical second edge of the door when the door is in the closed position, the free exterior end of the latch having an interior edge (50) adjacent to the door when in the extended orientation, the free exterior end of the latch having an exterior edge (52) spaced from the door when in the extended orientation, the latch having a width between the interior edge (50) and the exterior edge (52);

the striker plate (14) having a generally planar configuration, the striker plate having an exterior edge (56) and an interior edge (58), a shallow recess (60) in the vertical second side casing receiving the striker plate, the striker plate having a latch-receiving hole (18) in a generally rectangular configuration, a deep recess (64) in the vertical second side casing adjacent to the generally rectangular latch-receiving hole, the latch-receiving hole (18) having an inner side 66 and an outer side (68) defining a hole width, the striker plate having a plurality of countersunk holes (72) for coupling the striker plate to the vertical second side casing, the exterior edge of the striker plate being formed with an inwardly extending bend 66 directed toward the vertical second side casing, the inwardly extending bend adapted to be contacted by the free exterior end (48) of the latch when in the extended position to move the latch to the retracted orientation for movement into the latch-receiving hole in the striker plate and into the deep recess (64);

a supplemental hole (76) having a rectangular configuration formed on the striker plate and constituting an inwardly extending extension of the latch-receiving hole, a supplemental recess (78) in the vertical second side casing beneath the supplemental hole;

an adjustment block (80) having a rectilinear configuration coupled to the striker plate and extending into the supplemental hole, the adjustment block having a threaded aperture (82) with an axis, a threaded adjustment bolt (84) with a threaded end received in the threaded aperture, the threaded adjustment bolt having a head (86) located in the supplemental recess, a portion of the head being accessible to the user through the supplemental hole in the striker plate for rotation and axial movement to and from the latch-receiving hole to vary the width of the latch-receiving hole as a function of the width of the latch whereby play between the latch and the striker plate is abated, the adjustment block having set screws (88) in threaded holes (90) to secure the position of the adjustment bolt with respect to the striker plate and the latch.

* * * * *